US006030011A

United States Patent [19]

Layton

[11] Patent Number: 6,030,011

[45] Date of Patent: Feb. 29, 2000

[54] WASTE COLLECTION DEVICE

[76] Inventor: Charles E. Layton, 316 Wellington Pkwy., Noblesville, Ind. 46060

[21] Appl. No.: 09/204,234

[22] Filed: Dec. 3, 1998

[51] Int. Cl.[7] ..... A01K 29/00; E01H 1/12

[52] U.S. Cl. ..... 294/1.4; 15/257.4; 294/55

[58] Field of Search ..... 294/1.3, 1.4, 1.5, 294/53.5, 55; 15/104.8, 257.1, 257.2, 257.3, 257.4, 257.7

[56] References Cited

U.S. PATENT DOCUMENTS

| | | | |
|---|---|---|---|
| 3,281,178 | 10/1966 | Fisher | 294/1.4 |
| 3,802,729 | 4/1974 | Akre . | |
| 3,827,098 | 8/1974 | Sanderson . | |
| 3,977,715 | 8/1976 | Casci | 294/1.4 |
| 4,047,746 | 9/1977 | Radowski . | |
| 4,146,259 | 3/1979 | Schultz | 294/1.4 |
| 4,154,389 | 5/1979 | Dell'Anno . | |
| 4,222,597 | 9/1980 | Willis | 294/1.4 |
| 4,257,636 | 3/1981 | Mainprice . | |
| 4,360,229 | 11/1982 | Kinney . | |
| 4,705,310 | 11/1987 | Scripter . | |
| 4,986,587 | 1/1991 | Lozano | 294/1.4 |
| 5,039,149 | 8/1991 | Gish | 294/1.4 |
| 5,236,237 | 8/1993 | Shultz . | |

*Primary Examiner*—Johnny D. Cherry
*Attorney, Agent, or Firm*—Shlesinger Arkwright & Garvey, LLP

[57] ABSTRACT

A hand-held waste collection device comprising a handle having first and second ends and a waste receptacle mounted to the handle second end, the receptacle including a top surface, a bottom surface and side walls forming an open front end and an open back end, and a slot formed in each of the side walls, each of the sidewall slots adjacent the bottom surface and substantially parallel thereto whereby a liner may be slidingly received over the receptacle top surface and the side walls to thereby be maintained in an open position for receiving waste therein.

16 Claims, 3 Drawing Sheets

WASTE COLLECTION DEVICE

FIELD OF THE INVENTION

This invention relates to devices for collecting animal waste, and in particular, a hand-held scoop device for use by pet owners.

BACKGROUND OF THE INVENTION

Devices for collection of animal waste or fecal material are well known. Generally speaking, these devices consist of a long handle having at one end a scoop or container for receiving the animal waste to be collected.

Of these prior art devices, several teach pivoting-type scoops movable between a horizontal and vertical position. These devices include U.S. Pat. No. 3,802,729 to Akre and U.S. Pat. No. 5,236,237 to Shultz.

Still other prior art devices are fitted with a collection bag for receiving the animal waste. After the waste is collected into the bag, it is sealed and disposed of in a sanitary manner. Representative devices adapted to receive a liner or bag include U.S. Pat. No. 4,047,746 to Radowski and U.S. Pat. No. 4,154,389 to Dell'Anno.

The prior art devices are not entirely satisfactory. In particular, prior art scoops adapted to receive a disposable bag are cumbersome to use and in many cases, the waste being collected will inadvertently come in contact with the non-bag portions of the device. In that situation, the device must be cleaned following use. In addition, it has been found that the liner bags of prior art devices are easily torn or disengaged during use. A torn or disattached bag thus requires the user to manually reattach the bag or otherwise collect the waste in an unsanitary manner. Even if the liner bag does not tear or disattach during use, all prior art devices require manual lifting of the bag from the container. As is obvious, any handling of the bag together with the contents is undesirable.

In addition to the above, many of the prior art devices are complicated in construction and operation thereby increasing the likelihood of failure.

In view of the above, a need has existed in the art for an animal waste collection device which overcomes the above noted disadvantages.

OBJECTS AND SUMMARY OF THE PRESENT INVENTION

It is therefore an object of the present invention to provide an improved animal waste collection device having the scoop or container portion configured to receive a liner bag in a manner that will protect surfaces of the scoop from contact with the animal waste and also minimizes contact of the container with the collected waste.

It is a further object of the present invention to provide a waste collection device having a liner bag fitted onto the scoop portion and removable from the scoop portion about a single attachment point forward of the scoop and further, to provide an open scoop back whereby removal of the bag containing the waste is achieved by release of he attachment point to thereby allow the back to pass through the open back.

A still further object of the present invention is to provide a device for receiving animal waste that may be operated in an efficient manner and sanitary manner.

A still further object of the present invention is to provide a device that can be efficiently manufactured at a low cost.

Another object of the present invention is to provide a device that may be easily cleaned and kept in a sanitary manner.

An additional object of the present invention is to provide a liner bag that may be attached to the scoop without the need for clips or other complicated securing devices.

These and other objects of the present invention will become apparent from the detailed description of the invention below.

In summary, the present invention is directed to a hand-held waste collection device comprising a handle having first and second ends, a waste receptacle mounted to the handle second end, the receptacle including a top surface, a bottom surface and side walls forming an open front end and an open back end, and a slot formed in each of the side walls, each of the sidewall slots are adjacent the bottom surface and substantially parallel thereto whereby a liner may be slightly received over the receptacle top surface and the side walls to thereby be maintained in an open position for receiving waste therein.

The present invention is also directed to a waste collection device comprising a handle having first and second ends, a frame member mounted to the handle second end, the frame member including a bottom wall, a top wall and a pair of side walls forming an opening extending therethrough, the bottom wall having at least one end extending beyond the opening and the side walls extending adjacent the bottom wall and only connected thereto at a discrete edge thereof to form a generally U-shaped channel, and a liner, the liner configured to extend over the top wall, side walls and bottom surface to form a pocket for receiving waste, the liner only secured to the bottom wall and at least one end extending from the said opening.

DETAILED DESCRIPTION OF THE PREFERRED EMBODIMENTS

Figure 1:
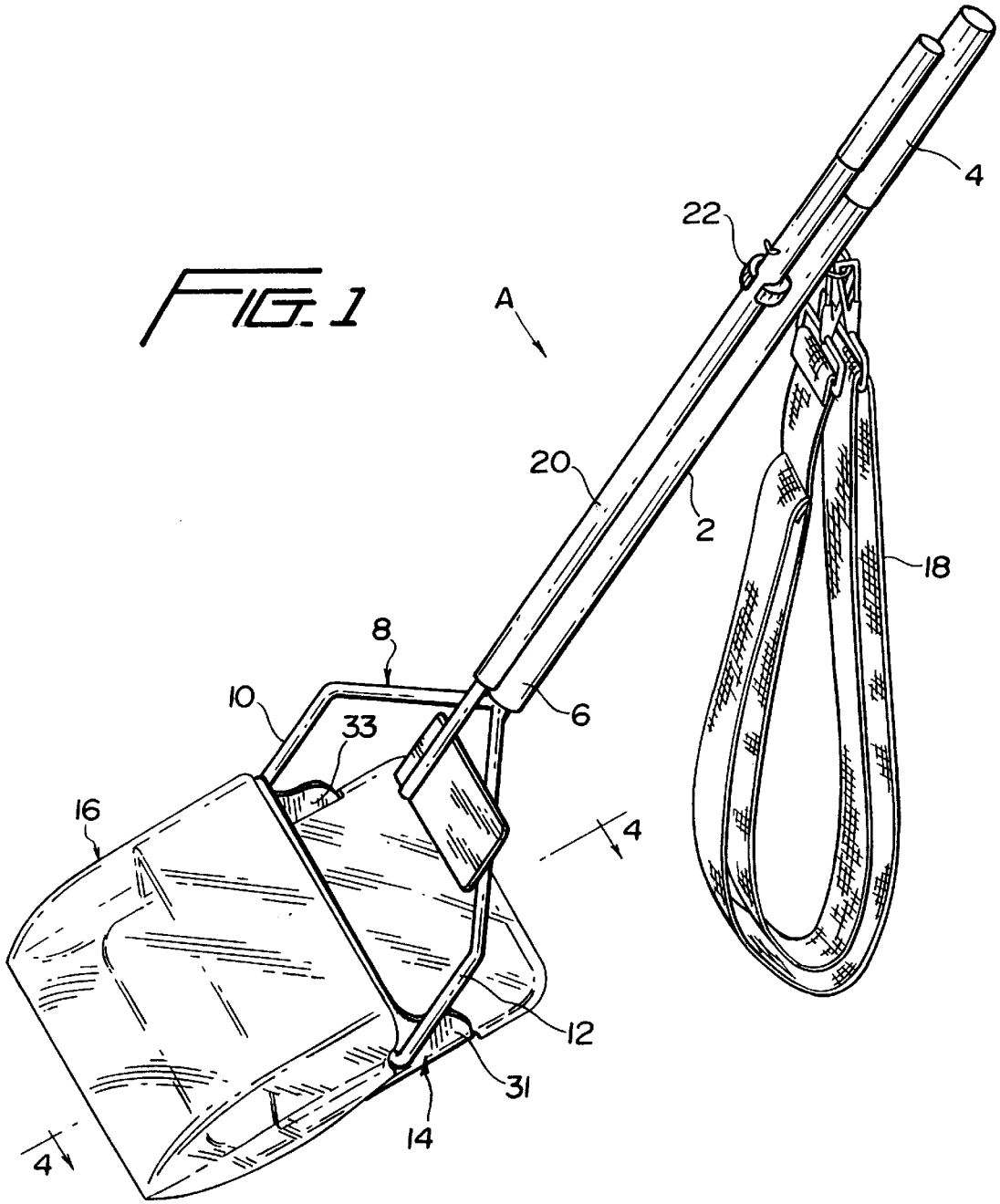
FIG. 1 is a perspective view of the device according to the present invention including a liner bag secured to the scoop portion of the device and further including a carrying strap and rake device secured to the handle.

Referring to the figures and in particular FIG. 1, the collection device A is shown and generally comprises a handle member 2 having a grasping end 4. The opposite end 6 of the handle includes a bail element 8 having first and second prong members 10 and 12. A scoop or container portion 14 is pivotally secured to bail element 8 and in a manner to be further explained below. The scoop portion 14 is shown fitted with a disposable liner bag 16 for receiving and containing the waste to be collected. Also shown is a carrying strap 18 and a rake device 20 releasably secured to the handle member 2 by clip 22.

Figure 5:
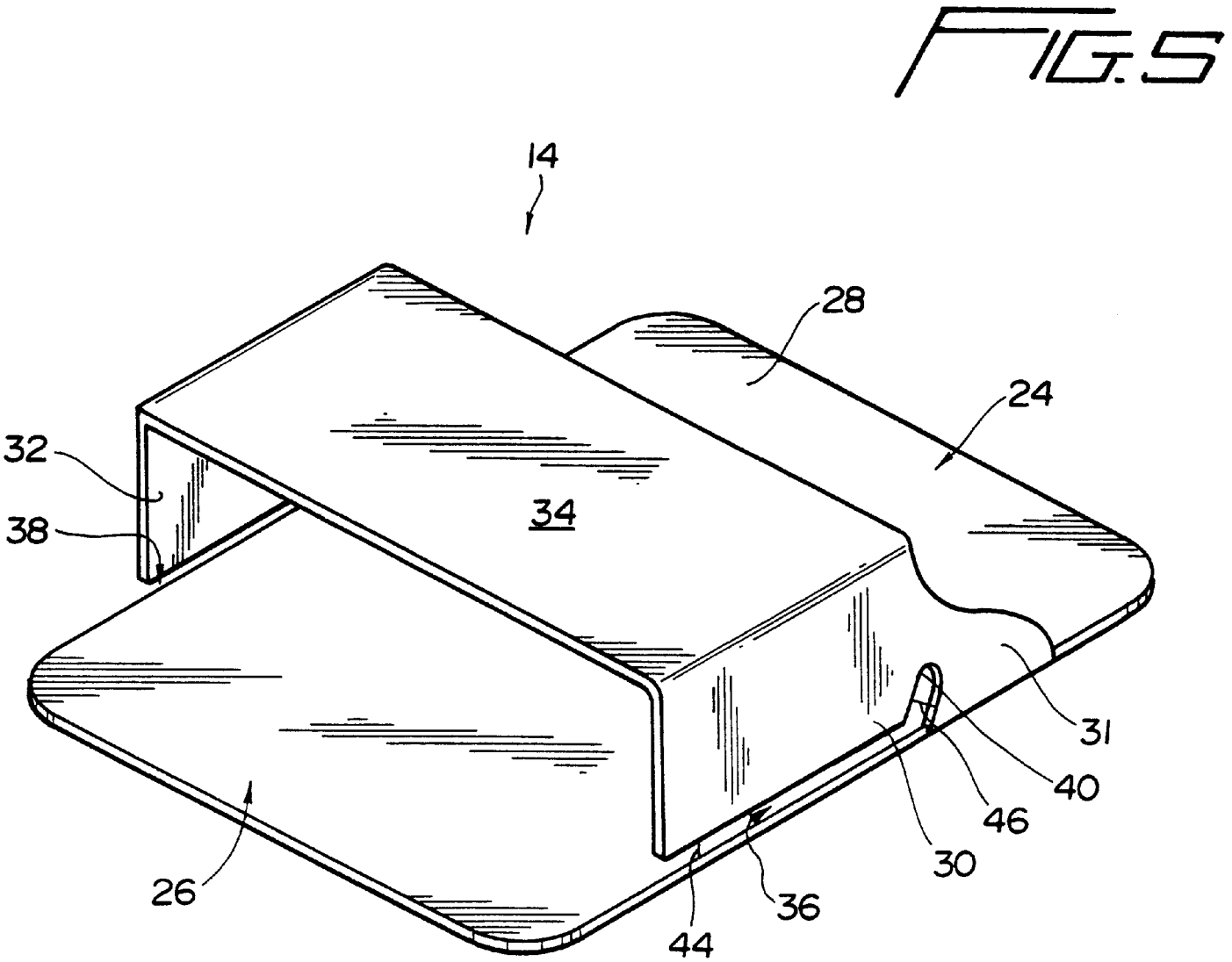
FIG. 5 is a perspective view of the scoop portion of the present invention without the handle and bail member.

Turning to FIG. 5, the scoop portion 14 is shown in greater detail and includes a front end 24 and back end 26.

The device has a generally rectangular configuration having openings at each of the front end 24 and back end 26. The scoop portion 14 includes a bottom surface 28 and top surface 34 interconnected about respective side walls 30 and 32 by flanges 31 and 33 (not shown). Each of the side walls 30 and 32 is provided with a side channel 36 and 38, respectively.

The channel 36 is shown to extend through side wall 30 at a location adjacent the bottom surface 28 and including an upwardly extending end portion 40. Similarly, side wall 32 also includes a channel 38 terminating in an upwardly extending end portion 42. In a preferred embodiment, the width of each side channel is less than the width of the respective channel end portion. This is best shown in FIG. 5 with width 44 of side channel 36 shown to be less than width 46 of channel end portion 40. The opposite channel and end portion are similarly sized. The width differential prevents the prong members 10 and 12 of the bail 8 from being displaced outside of each respective end portion 40 and 42.

Figures 2, 3:
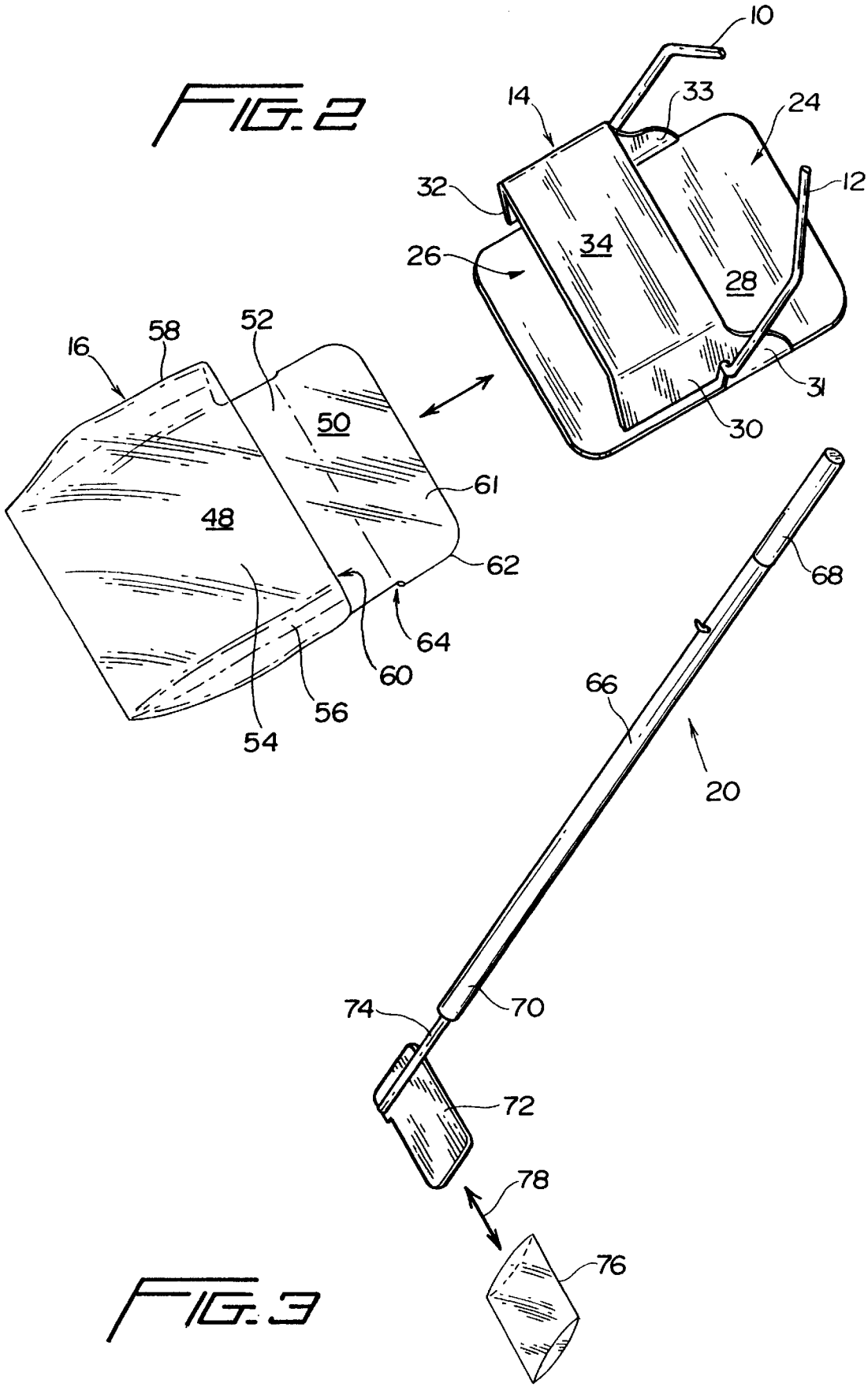
FIG. 2 is a perspective view of the scoop portion of the present invention in alignment with a liner bag prior to attachment or following use.
FIG. 3 is a perspective view of a rake device shown in FIG. 1 and further illustrating a liner for attachment to the rake portion of the device.

Turning to FIG. 2, the disposable bag or liner 16 is shown in greater detail. In particular, the disposable bag 16 is shown to include a pair of opposed pockets 48 and 50, each pocket being formed along an opposite surface of sheet 52. Pocket 48 is significantly larger in size and functions to receive the waste collected by the device. Pocket 50 functions to secure the liner 16 to the scoop portion 14 along the front end surface 24 of the bottom 28. This is best shown in each of FIGS. 1 and 4.

Pocket 48 comprise a top sheet 54, a bottom sheet 53 formed integral with sheet 52 and side walls 56 and 58 with an opening extending in the direction of arrow 60. The second pocket 50 comprises a top sheet 62 and a bottom sheet 61 joined along side edges with an opening extending in the direction of arrow 64. Second pocket 50 is best shown secured to the scoop portion 14 in FIG. 4; the front end 24 of scoop bottom 28 is inserted into the interior of the pocket 50.

It is within the scope of the present invention to construct the disposable bag 16 from a variety of materials including plastic, paper, or the like. This material selected will preferably allow the disposable bag or liner 16 to firmly interfit onto the scoop portion 14 as will be further explained below. A disposable bag or liner 16 constructed from plastic or other resinous material can be easily and securely sealed further promoting the sanitary advantages of the present invention.

An additional feature of the present invention is shown in FIG. 3 and comprises rake or shovel device 20. Rake device 20 comprises a handle 66 having a gripping end 68 and a work end 70. A rake or shovel portion 72 extends from the work end 70 of handle 66 and is interconnected by extension 74. The rake member or shovel portion 72 is shown to comprise a generally planar surface of square or rectangular configuration attached at one end to the extension 74. As is apparent, other configurations are within the scope of the present invention so long as the rake member or shovel portion 72 is readily adapted to assist in conveying the waste material into the collection device A. Also shown in FIG. 3 is a disposable sleeve or cover 76 preferably constructed from the same material as disposable bag 16. The disposable sleeve or cover 76 will interfit onto the surface of rake member or shovel 72 and thereby maintain the surface of the rake member shovel 72 in a sanitary condition during use of the device. The disposable sleeve or cover 76 may be discarded following use by simply slipping the cover off of the surface rake member or shovel in the direction of arrow 78.

Figure 4:
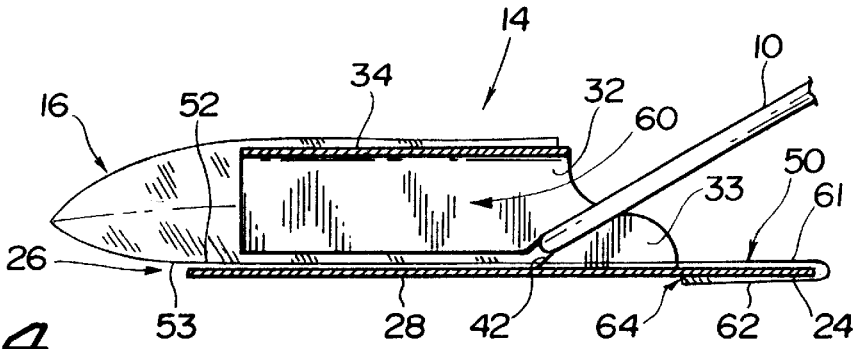
FIG. 4 is a cross-sectional view taken along lines 4—4 of FIG. 1 with portions of the scoop device broken away.

Referring to FIGS. 1, 2 and 4, operation of the collection device A can be readily understood. A dog owner will carry the device by hand or over his shoulder using carrying strap 18. When collection of the animal waste is required, or even prior to collecting waste, the user will affix the disposable bag or liner 16 onto the scoop portion 14 of the collection device A.

This is achieved by aligning the bag with the scoop and in the manner as shown in FIG. 2 whereby the disposable bag is positioned rearwardly of the back end 26 of scoop portion 14 with the opening of pocket 48 aligned so that it readily receives the top 34 and side walls 30 and 32 of scoop 14. More particularly, the side walls 56 and 58 of bag 16 are received by each respective side channel 36 and 38 so that sheet 52 of the bag 16 covers the entire surface of scoop bottom 28. Thus, the pocket 48 is maintained in a fully opened position for receiving waste by the top 34 and side walls 30 and 32 of the scoop. The sheet 52 of the bag or liner 16 will cover the bottom surface 28 of the scoop 14. This is best shown in FIG. 4. To secure the bag 16 to the scoop portion 14, the second pocket 50 is then interfit onto the front end 24 of the scoop 14.

The scoop portion 14 having the disposable bag 16 firmly affixed in an open position may then be positioned adjacent the waste material to be collected (not shown) with the front end 24 positioned closest to the waste. The operator will then disengage the rake device 20 from the handle member 2 and rake or otherwise urge the waste into the interior of the disposable bag affixed to the scoop portion 14 by pushing it into the opening created by pocket 48. As shown in FIG. 3, the disposable sleeve or cover 76 may be affixed to the rake member or shovel 72 of rake device 20.

As is apparent, positioning of second pocket 52 onto the forward or front surface 24 of scoop portion 14 also functions to reduce the likelihood of disengagement of the bag since sweeping of the waste in a direction towards the interior of pocket 48 will also cause engagement between the second pocket 50 and the front end 24 of the scoop 14.

Once the waste has been swept into the interior of open pocket 48, the scoop is lifted off of the ground and caused to pivot into a vertical position due to the weight of the material collected in bag 16. The operator will then disengage pocket 50 from the front end of scoop portion 14 and allow the bag containing the collected waste to slide rearwardly away from the scoop portion 14 and out of back end 26. The disengaged disposable bag 16 containing the waste material may then be secured by a tie or otherwise disposed of in a sanitary manner (not shown). Following use, the rake device 20 may be resecured to the handle member 2 by way of clip 22 and the operation is complete.

As is apparent, the construction of the collection device and in particular the pivoting scoop portion 14 having a disposable bag 16 covering the bottom surface 28 of the scoop 14 together with disengagement away from the scoop 14 rearwardly serves to minimize contact of the scoop portion 14 with the waste. More particularly, the user merely disengages the pocket 50 from the front surface of the scoop portion 14 allowing the waste and the bag to fall away rearwardly from the device and in an efficient manner.

The construction materials of collection device A includes all manner of plastic and synthetic materials as well as metal such as aluminum or the like The bail prong members 10, 12 may be secured by gaskets or other means rather than the width differential of the channel end portions. In an alternative embodiment, the upwardly extending channel end portions may be substituted for a simple passageway extending through each side of the side walls 32 to receive a separate prong member 10 or 12.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. A hand-held waste collection device comprising:

a) a handle having first and second ends;

b) a waste receptacle mounted to said handle second end, said receptacle including a top surface, a bottom surface and side walls forming an open front end and an open back end; and c) a slot formed in each of said side walls, each of said sidewall slots adjacent said bottom surface and substantially parallel thereto whereby a liner may be slidingly received over said receptacle top surface and said side walls and through said side wall slots to thereby be maintained in an open position for receiving waste therein.

2. A waste collection device as in claim 1 and wherein:

a) said receptacle is pivotally mounted to said handle second end.

3. A waste collection device as in claim 1 and wherein:

a) each of said sidewall slots including an end portion coextensive therewith and having a width greater than said each of said sidewall slots.

4. A waste collection device as in claim 3 and further including:

a) a bracket member, said bracket member having a first end and a second end, said bracket member second end including bifurcated first and second prong members, each of said first and second prong members pivotally received within a separate one of said sidewall slot end portions.

5. A waste collection device as in claim 1 and further including:

a) a liner, said liner comprising a base sheet including a first open pocket at one end thereof and a second open pocket at an opposite end thereof, each of said open pockets formed on opposite sides of said base sheet, said first open pocket is slidingly received by said sidewall slots and disposed over said receptacle top surface and said side walls to form an opening therein and coextensive with said receptacle open front end, said second open pocket including an opening for receiving an end surface of said receptacle bottom surface to secure said liner thereto.

6. A waste collection device as in claim 1 and further including:

a) a rake device for pushing waste into said waste receptacle, said rake device releasably retained on said handle.

7. A waste collection device as in claim 6 and further including:

a) a cover for said rake device.

8. A waste collection device as in claim 1 and further including:

a) a carrying strap, said carrying strap secured to said handle.

9. A waste collection device comprising:

a) a handle having first and second ends;

b) a frame member mounted to said handle second end, said frame member including a bottom wall, a top wall and a pair of side walls forming an opening extending therethrough, said bottom wall having at least one end extending beyond said opening and said side walls extending adjacent said bottom wall to form respective channels therealong, said side walls only connected to said bottom wall by flange members; and c) a liner, said liner extending over said top wall, side walls and bottom wall and through said channel to form a pocket to receive waste.

10. A waste collection device as in claim 9 and wherein:

a) said frame member is pivotally mounted to said handle second end.

11. A waste collection device as in claim 9 and wherein:

a) each of said respective channels including an end portion coextensive therewith and having a width greater than said each of said respective channels.

12. A waste collection device as in claim 11 and further including:

a) a bracket member, said bracket member having a first end and a second end, said bracket member second end including bifurcated first and second prong members, each of said first and second prong members pivotally received within at least one of said end portions.

13. A waste collection device as in claim 9 and wherein:

a) said liner comprising a base sheet including a first open pocket at one end thereof and a second open pocket at an opposite end thereof, each of said open pockets formed on opposite sides of said base sheet, said first open pocket is slidingly received by said each of said respective channels and disposed over said top wall and said side walls to form an opening therein and coextensive with said frame member opening, said second open pocket including an opening for receiving an end surface of said bottom wall to secure said liner thereto.

14. A waste collection device as in claim 9 and further including:

a) a rake device for pushing waste into said waste collection device, said rake device releasably retained on said handle.

15. A waste collection device as in claim 14 and further including:

a) a cover for said rake device.

16. A waste collection device as in claim 9 and further including:

a) a carrying strap, said carrying strap secured to said handle.

* * * * *